US010034511B1

(12) United States Patent
Bulat

(10) Patent No.: US 10,034,511 B1
(45) Date of Patent: Jul. 31, 2018

(54) ATHLETIC HELMET WITH MAGNETIC SYSTEM

(71) Applicant: American Doctors Online, Inc., Fairhaven, MA (US)

(72) Inventor: Paul I. Bulat, Brewster, MA (US)

(73) Assignee: American Doctors Online, Inc., Dartmouth, MA (US)

( * ) Notice: Subject to any disclaimer, the term of this patent is extended or adjusted under 35 U.S.C. 154(b) by 207 days.

(21) Appl. No.: 14/624,994

(22) Filed: Feb. 18, 2015

Related U.S. Application Data

(60) Provisional application No. 62/065,855, filed on Oct. 20, 2014, provisional application No. 61/940,887, filed on Feb. 18, 2014.

(51) Int. Cl.
*A42B 3/10* (2006.01)
*A42B 3/14* (2006.01)
*A63B 71/10* (2006.01)

(52) U.S. Cl.
CPC ..... *A42B 3/14* (2013.01); *A63B 71/10* (2013.01)

(58) Field of Classification Search
CPC .. A42B 3/06; A42B 3/064; A42B 3/14; A42B 71/70
See application file for complete search history.

(56) References Cited

U.S. PATENT DOCUMENTS

2013/0042397 A1* 2/2013 Halldin ..... A42B 3/064 2/411
2014/0215693 A1 8/2014 O'Gara
2014/0259308 A1 9/2014 Moss et al.
2014/0283286 A1* 9/2014 Yoon ..... A42B 3/069 2/411

FOREIGN PATENT DOCUMENTS

CA 2795808 A1 5/2013
WO 2010123797 A1 10/2010

* cited by examiner

*Primary Examiner* — Anna Kinsaul
(74) *Attorney, Agent, or Firm* — Sunstein Kann Murphy & Timbers LLP

(57) ABSTRACT

An athletic helmet includes an outer shell, having an outer surface and an inner surface, shaped to receive a head, and a magnetic system disposed adjacent to the inner surface. The magnetic system has at least one magnet configured to have one pole aligned such that its magnetic dipole moment is oriented approximately normal to the outer surface and a magnetic holding device configured to allow the at least one magnet to slidably move along a surface of the magnetic holding device.

22 Claims, 7 Drawing Sheets

ATHLETIC HELMET WITH MAGNETIC SYSTEM

CROSS REFERENCE TO RELATED APPLICATIONS

The present invention claims the benefit of U.S. Provisional Patent Application No. 62/065,855 filed Oct. 20, 2014 and the benefit of U.S. Provisional Patent Application No. 61/940,887 filed Feb. 18, 2014, the disclosures of which are incorporated by reference herein in their entirety.

TECHNICAL FIELD

The present invention generally relates to athletic helmets and, more particularly, the invention relates to athletic helmets with magnetic systems for use in contact sports.

BACKGROUND ART

Traumatic brain injuries range from acute mild head injury to acute intracerebral hemorrhage. Chronic manifestations of head injuries are myriad, including chronic traumatic encephalopathy (CTE), a progressive degenerative disease attacking individuals who have experienced repetitive brain trauma, such as concussions. Chronic manifestations of CTE may occur years after the brain insult and include many forms of cognitive impairment such as memory loss, confusion, dementia and depression.

These matters have been recently brought to light by football players who have developed symptoms associated with CTE, having sustained multiple head injuries during their football career within the National Football League.

Despite the best efforts of football helmet manufacturers, traumatic forces, as a result of helmet-to-helmet contact, continue to be transmitted to the brain, resulting in neuronal and axonal injury and brain cell death.

Efforts to minimize such trauma by inventors and manufacturers have focused on improvements within the helmet including padding, foams, and air bags within the player's helmet. Despite best efforts, today's helmets do not prevent concussive injuries, as helmet to helmet contact is not minimized, thereby allowing for head injury, which have both short and long-term consequences.

In Canadian Patent Application 2,795,808, a shock-absorbing helmet is described with a pair of magnets. The magnet elements are disposed between an interior liner and an outer shell with magnetic protection afforded only upon impact, and only upon attempted compression of the outer shell of the helmet—the higher the impact, the more attempted compression of the resin of the outer helmet, the higher the degree of magnetic force attempting to modulate the effects of the collision. If two helmets, configured according to Canadian Patent Application 2,795,808, were to collide, then the shell thickness in both helmets would prevent the outer magnets in both helmets from closing within a maximum repulsive range (e.g., prevent magnet to magnet contact). For example, if the thickness of each football helmet's outer shell is 3 millimeters or greater, then there would be a 6 millimeter or greater separation distance between the magnet elements. This 6 millimeter or greater separation distance would eliminate the maximum repulsive force between the magnets in the two helmets. For example, two neodymium magnets (Grade N52) with a diameter of 0.4375 inches, a thickness of 0.125 inches, and a separation distance of 0 inches (touching) have a maximum repulsive power of 6.72 lbs. If the magnets are separated by 6 millimeters (0.236 inches), their magnetic repulsive power is reduced to approximately 0.5 lbs. See, e.g., FIG. 1. Canadian Patent Application 2,795,808 does not attempt to prevent impact between two players' helmets. The stiff, solid exterior resin would transmit concussive effects to the head, notwithstanding the magnets between the interior liner and the outer shell. The magnets' presence would serve to strengthen or stiffen the helmet. Therefore, the forces of two colliding helmets would be transmitted to the respective player's brain.

SUMMARY OF EMBODIMENTS

In accordance with one embodiment of the invention, an athletic helmet includes an outer shell, having an inner surface, shaped to receive a head, and a magnetic system disposed adjacent to the inner surface. The magnetic system has at least one magnet configured to have one pole aligned such that its magnetic dipole moment is oriented approximately normal to the outer surface and a magnetic holding device configured to allow the at least one magnet to slidably move along a surface of the magnetic holding device.

In accordance with another embodiment of the invention, an athletic helmet includes an outer shell, having an inner surface, shaped to receive a head, a magnetic system disposed adjacent to the inner surface, and a flux shunt disposed adjacent to the magnetic system and positioned between the magnetic system and the head in order to shield the head from flux from the magnetic system. The magnetic system has at least one magnet configured to have one pole aligned such that its magnetic dipole moment is oriented approximately normal to the inner surface.

In some embodiments, the magnetic system may further include padding disposed adjacent to the inner surface, and the magnetic system may be embedded within or coupled to the padding. The magnetic system may include magnets of various shapes and configurations. The magnetic system may be coupled to the inner surface of the outer shell. The magnetic holding device may be formed from a rubber material with imbedded magnetic material conventionally magnetized with the north pole on one side or face of the magnetic holding device and the south pole on the other. The magnetic system may include a plurality of magnets disposed in an array on the magnetic holding device. The array of magnets may include smaller magnets disposed between larger magnets in order to form a non-uniform magnetic flux field. The athletic helmet may further include a flux shunt disposed adjacent to the inner surface of the outer shell and positioned between the magnetic system and the head in order to shield the head from flux from the magnetic system. The magnetic system may be disposed over substantially all of a contact area of the outer surface or the inner surface. The athletic helmet may further include a face guard disposed on a portion of the outer shell. The face guard has a face guard magnetic system disposed on or in the face guard and the face guard magnetic system has at least one magnet configured to have one pole aligned such that its magnetic dipole moment is oriented approximately normal to an outer surface of the face guard. One or more of the magnets may have a shape of a disc, a block, a ring, and/or a cylinder. A plurality of helmets may be formed and each helmet may have its magnetic system configured in a similar manner with the same pole (e.g., north pole or south pole) oriented toward the outer surface or the inner surface, such that a repulsive force is produced between two or more of the helmets when the helmets come close to or contact one another.

BRIEF DESCRIPTION OF THE DRAWINGS

The foregoing features of the invention will be more readily understood by reference to the following detailed description, taken with reference to the accompanying drawings, in which.

DESCRIPTION OF ILLUSTRATIVE EMBODIMENTS

Various embodiments of the present invention provide an athletic helmet with a magnetic system that is configured to repel other approaching helmets for use in contact sports. Embodiments of the present invention apply forces associated with magnetism to minimize or eliminate the collision itself, the underlying nexus associated with traumatic brain injury, in contrast to previous improvements to helmet technology, which typically attempt to minimize the consequences of a helmet-to-helmet collision (as in Canadian Patent Application 2,795,808). While the below discussion is focused on football helmets and the sport of football in general, other athletic sports and applications may also be used, e.g., such as lacrosse, hockey, soccer, etc. Details of illustrative embodiments are discussed below.

Figure 1:
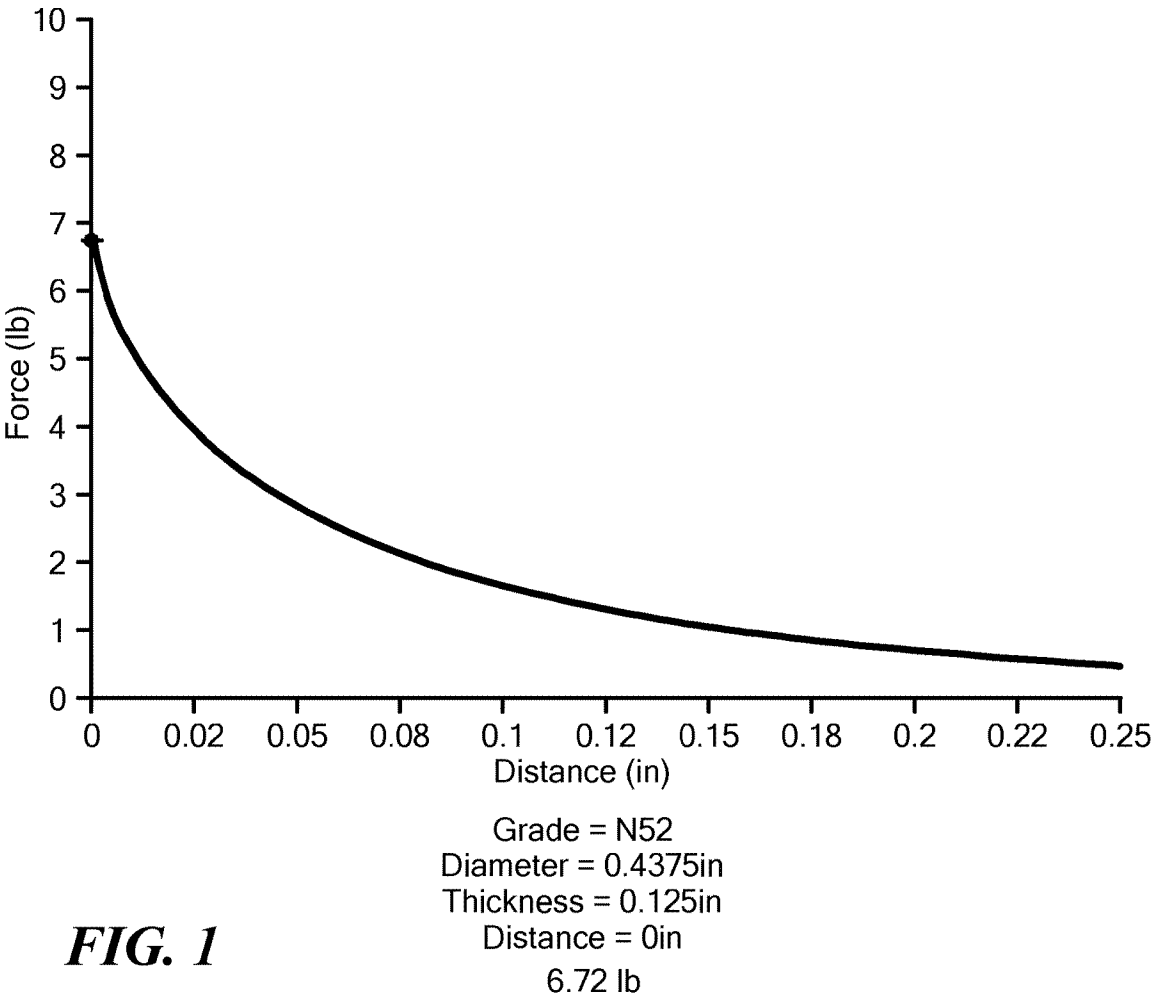
FIG. 1 is a graph of force versus distance showing the magnetic repulsive power for two neodymium magnets, grade N52.
Figure 2:
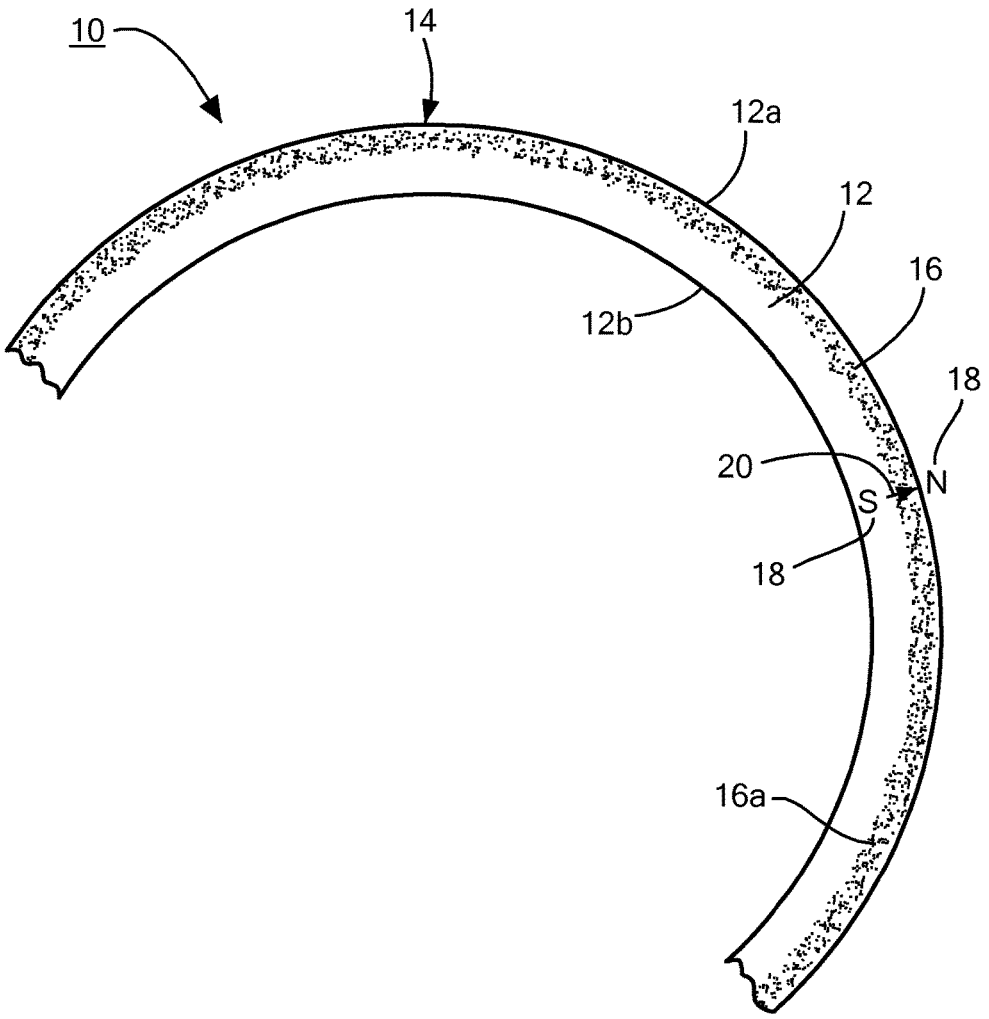
FIG. 2 schematically shows a cross-sectional view of one portion of an athletic helmet with an embedded magnetic system according to embodiments of the present invention.
Figure 3:
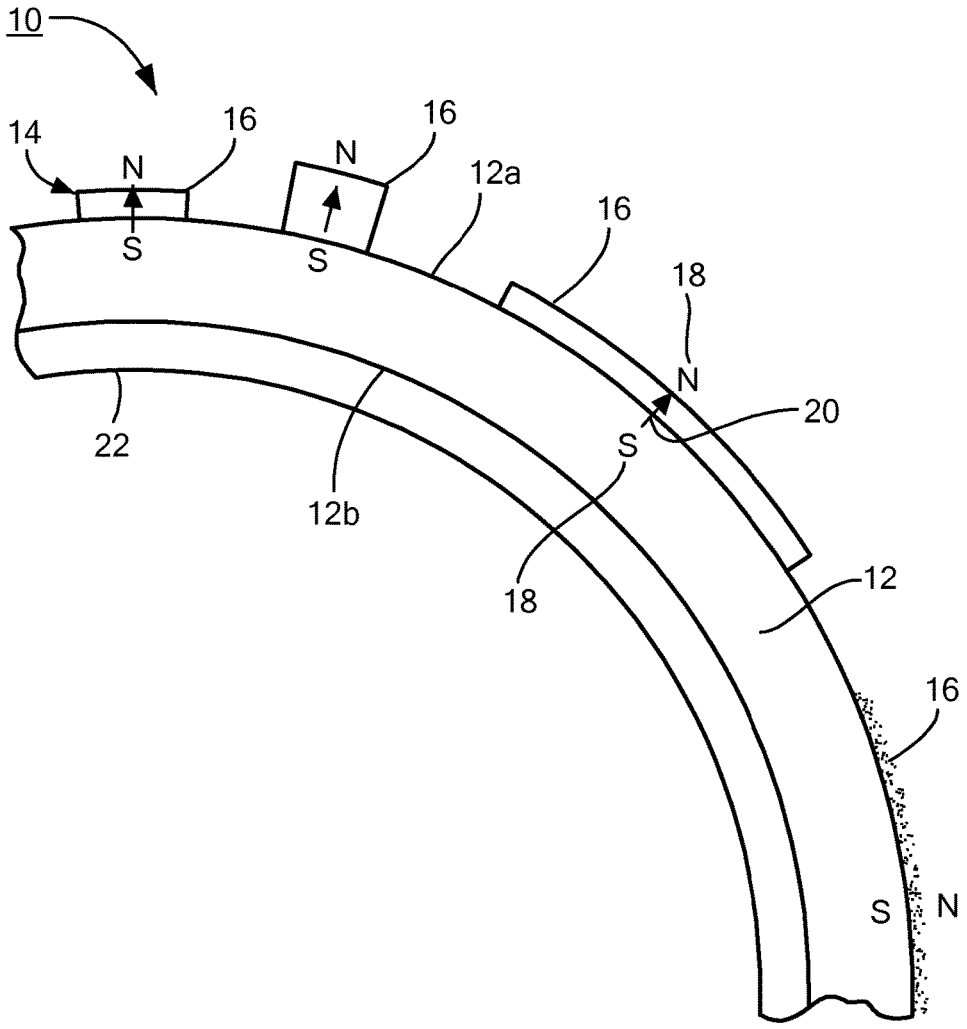
FIG. 3 schematically shows a cross-sectional view of one portion of an athletic helmet with different configurations of a magnetic system according to embodiments of the present invention.

FIGS. 2 and 3 show various configurations of an athletic helmet having a magnetic system according to embodiments of the present invention. The athletic helmet 10 includes an outer shell 12, having an outer surface 12*a* and an inner surface 12*b*, shaped to receive a head, and a magnetic system 14 disposed on or in the outer surface 12*a* or adjacent to the inner surface 12*b* (not shown). The magnetic system 14 has at least one magnet 16 configured to have one pole 18 (e.g., north or south pole) aligned such that the magnetic dipole moment 20 of the magnet 16 is oriented approximately normal to the outer surface 12*a* when on or in the outer surface 12*a*, or oriented approximately normal to the inner surface 12*b* when adjacent to the inner surface 12*b*.

FIG. 2 shows an athletic helmet 10 with a magnetic system 14 disposed in the outer surface 12*a* of the helmet 10, although the magnetic system 14 may also be disposed in the inner surface 12*b* or adjacent to the inner surface 12*b*. As shown in FIG. 2, high flux magnetic powder 16*a* may be combined with the helmet material (e.g., polycarbonate) during the manufacturing process of athletic helmets. Alternatively, or in addition, high flux magnetic powder 16*a* may be attached to or combined with other components of the helmet (e.g., padding) during the manufacturing process of the other components. Prior to the curing or hardening process of the plastic for the helmet or processing of the other components, a strong external magnet may be applied over the helmet 10 or other components with the south pole of the magnet facing the helmet or other component material and magnetic powder 16*a*. This will result in the orientation of the magnetic powder 16*a* with the north pole facing the outer surface 12*a* of the helmet 10 or other component and the magnetic dipole moment 20 oriented approximately normal to the outer surface 12*a*, as the north pole of each particle of magnetic powder 16*a* will be attracted to the south pole of the external magnet. Alternatively, the external magnet may be applied with the north pole of the magnet facing the helmet or other component and magnetic powder 16*a*, which will result in the magnetic powder 16*a* being aligned with the south pole facing the outer surface 12*a* of the helmet 10 or other component. Once the helmet or other component material or resin hardens, the magnetic particles 16*a* will be permanently oriented with one pole of the magnetic powder facing the outer surface 12*a* of the helmet 10 or other component and the magnetic dipole moment 20 of each magnetic particle oriented approximately normal to the outer surface 12*a*. For example, the padding disposed within the inner surface 12*b* of the helmet 10 may be manufactured with this process so that the magnetic particles are embedded within the padding and oriented approximately normal to the inner surface 12*b* of the helmet when the padding is coupled to the helmet 10. Helmets 10 or other components made with various types of materials, resins, glues and magnetic powders may be used.

Embodiments of the present invention include a plurality of helmets 10 manufactured in a similar manner, so that all of the helmets have the same pole (e.g., either the north pole or the south pole of the magnetic powder) facing the outer surface 12*a* or inner surface 12*b* of the helmet 10. Because of this orientation, football helmets approaching each other during the football game would repel each other since the same pole would be facing the outer surface of the helmet. This repulsive force would result in lessened trauma when contact is made or no trauma when the repelling magnetic forces are greater than the kinetic forces of both players' football helmets driving toward each other. In addition, assuming an indirect or oblique approach of the helmets, deflection of the helmets could result in the helmets passing to the side of each other, thereby eliminating contact altogether.

In all circumstances, a collision of the helmets 10 formed with a magnetic system 14 according to embodiments of the present invention would be less traumatic than without the magnetic system since the repulsive magnetic force of each magnet would initiate a "helmet to helmet braking system" as the helmets approached each other and the magnets 16 from opposing helmets came closer and closer together in distance.

FIG. 3 shows an athletic helmet 10 with different configurations of a magnetic system 14 disposed on the outer surface 12*a* of the helmet, although the magnetic system may also be disposed on the inner surface 12*b* of the helmet. One or more magnets 16 may be coupled to the outer surface 12*a* or the inner surface 12*b* of the helmet in various configurations with one pole oriented outward and other pole affixed to the helmet (axial magnetism), such that the magnetic dipole moment 20 of the magnet 16 is oriented approximately normal to the outer surface 12*a* or the inner surface 12*b*. For example, the north pole may be facing or oriented away from the outer surface with the south pole coupled to the helmet, as shown in FIG. 3. Alternatively, the north pole may be coupled to the inner surface of the helmet, or to the padding on the inner surface of the helmet, with the south pole facing or oriented away from the inner surface 12*b*. The magnets 16 may have the same or varying magnetic strengths on a helmet 10. The magnets 16 may be formed in various shapes, e.g., a disc, a block, a ring, a cylinder, a flat sheet, powders, a curved sheet molded to the surface of the helmet, or some other suitable configuration. The same shape may be used on a helmet or varying shapes may be used in combination with one another on the helmet. The magnets 16 may be disposed over substantially all of the contact area of the outer surface 12*a* or the inner surface 12*b*. The orientation of the surface magnets 16, while offering many designs, should, preferably, offer maximum surface magnetic repulsion of other helmets. The one or more magnets 16 may be coupled to the outer surface 12*a* or the inner surface 12*b* of the helmet 10 in any suitable manner e.g., using mechanical and/or chemical means. For example, the magnets 16 may be affixed to the outer surface 12*a* or the inner surface 12*b* of the helmet 10 with glues and adhesives, such as epoxy, cyanoacrylate, and urethane adhesives, or mechanically attached to the outer surface 12*a* or the inner surface 12*b* with hardware, such as bolts, nuts or screws. The one or more magnets 16 may be formed from any material composition, e.g., ceramic or ferrite magnets, Alnico magnets, samarium-cobalt magnets and/or neodymium magnets. Due to the strength of the magnet for a given size, neodymium magnets would be preferred. Alternatively, or in addition, the high flux magnetic powder 16*a* mentioned above may be applied to an adhesive tape or rubberized sheet (extrusion magnetization) and oriented in a manner such as discussed above with respect to FIG. 2, so that the same pole (e.g., either the north pole or the south pole of the magnetic powder) faces the outer surface of the tape, and then the adhesive tape may be applied to the external or internal surface of a football helmet or applied to a surface of the padding disposed within the helmet, as opposed to mixing with the resin of the shell or the padding material. The one or more magnets 16 may be coated with any suitable material, e.g., rubber or other coatings, in order to protect the magnets and reduce the chance of the magnet breaking upon contact with other magnets 16 or helmets 10.

Figure 4:
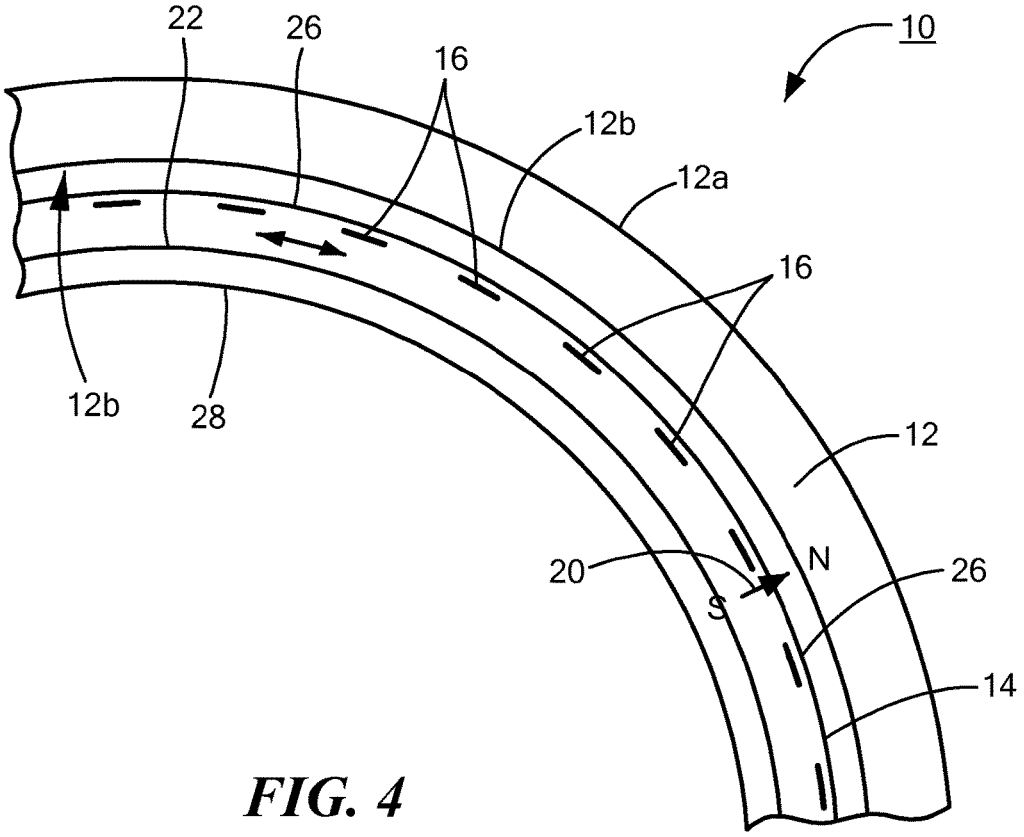
FIG. 4 schematically shows a cross-sectional view of one portion of an athletic helmet with a magnetic system having a magnetic holding device according to embodiments of the present invention.
Figure 5:
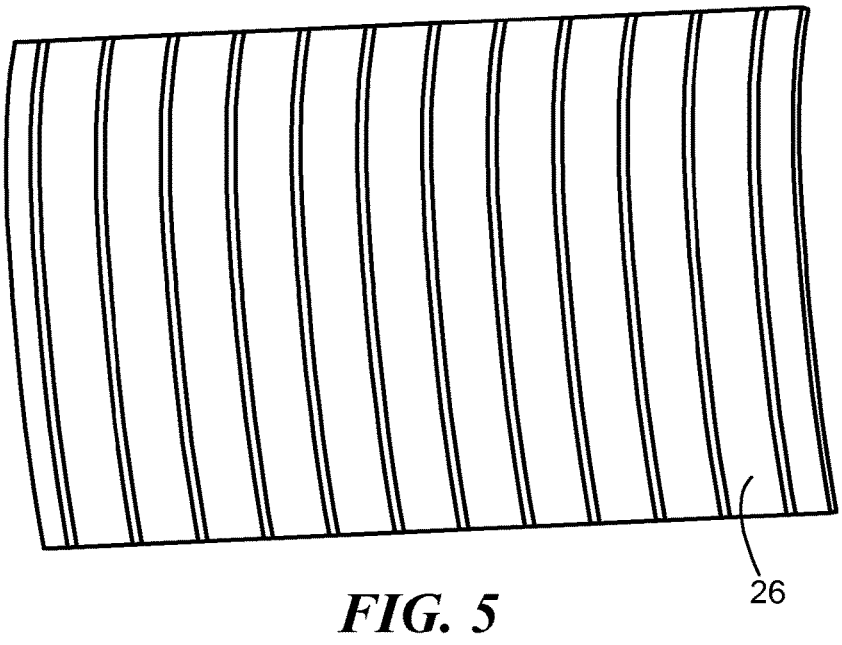
FIG. 5 is a prospective view of a magnetic holding device according to embodiments of the present invention.

FIG. 4 shows an athletic helmet 10 with a magnetic system 14 disposed adjacent to the inner surface 12*b* of the outer shell 12 according to embodiments of the present invention, although the magnetic system may also be disposed adjacent to the outer surface 12*a* of the outer shell. The magnetic system 14 includes a magnetic holding device 26 and one or more magnets 16 movably coupled to one surface of the magnetic holding device 26. The magnetic holding device 26 is preferably formed from a bendable material, such as a rubber or hardened rubber material, such as shown in FIG. 5, that includes a ferrous magnetic material or similar weaker magnetic material embedded throughout the material, such that the weaker bond between the magnets 16 and the ferrous magnetic material in the magnetic holding device 26 allows the magnets 16 to slide or move laterally along the face of the magnetic holding device 26, as shown by the arrows in FIG. 4. The magnetic holding device 26 is formed with the north pole on one side and the south pole on the opposite side. Preferably, the magnetic holding device 26 is about 3 in. wide and about 3 to about 6 in. long with about 0.020 in. to 0.120 in. thickness, although other dimensions may also be used.

Figure 6:
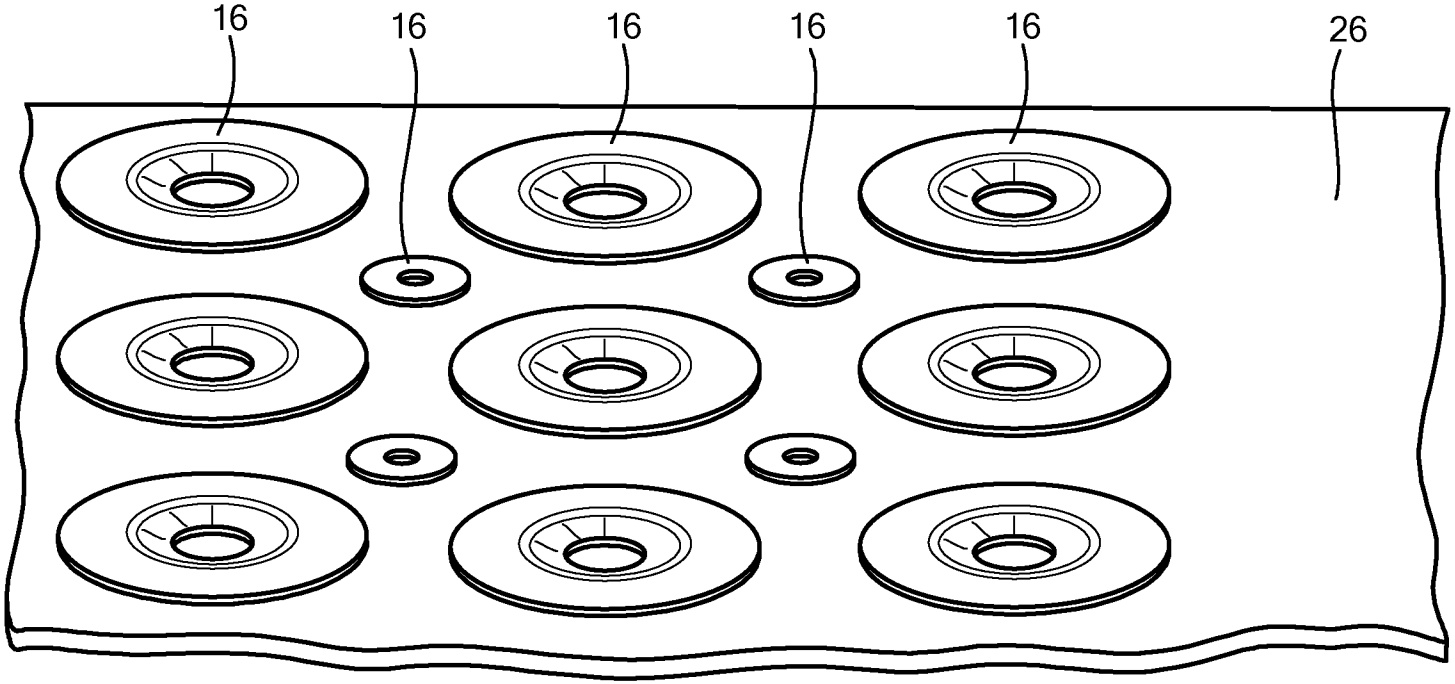
FIG. 6 is a prospective view of a magnetic holding device and ring magnet arrangement according to embodiments of the present invention.
Figure 7:
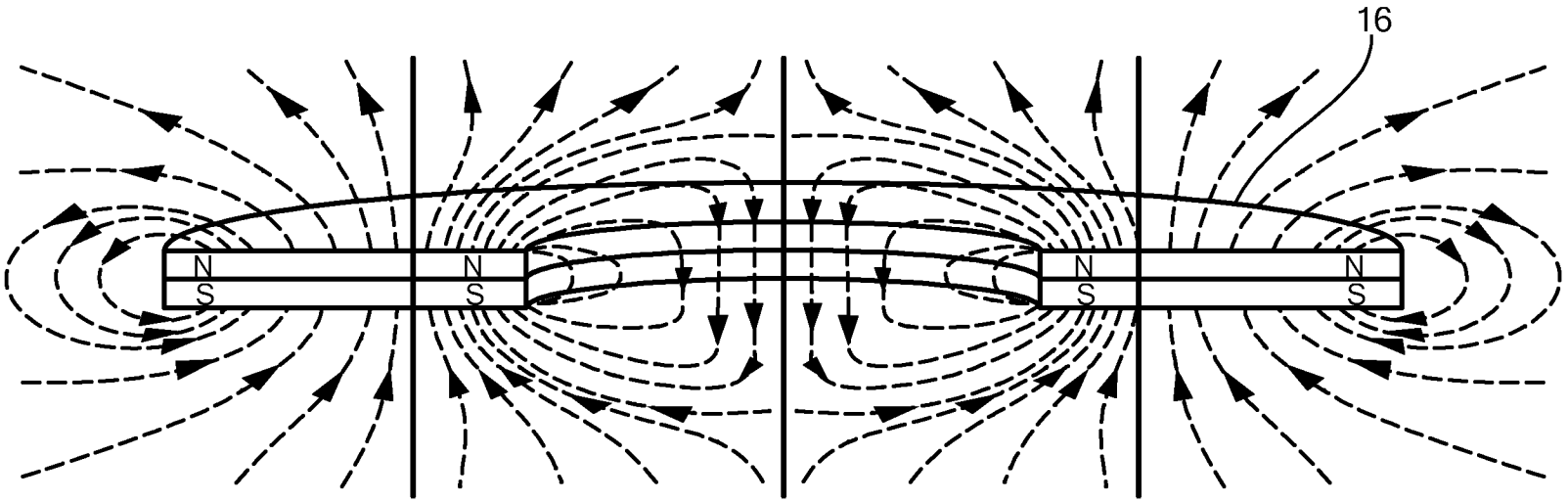
FIG. 7 schematically shows the magnetic flux of a ring magnet used in the magnetic system according to embodiments of the present invention.

The one or more magnets 16 may have various configurations with one pole oriented outward and other pole affixed to the magnetic holding device 26 (axial magnetism), such that the magnetic dipole moment 20 of the magnet 16 is oriented approximately normal to the inner surface 12*b*. For example, the north pole of the magnet 16 may be facing toward the inner surface 12*b* of the helmet 10 and movably coupled to the south pole of the magnetic holding device 26 with the south pole of the magnet 16 facing toward the head, as shown in FIG. 4. Alternatively, the south pole of the magnet 16 may be movably coupled to the north pole of the magnetic holding device 26 with the north pole of the magnet 16 facing toward the head. The magnets 16 may have the same or varying magnetic strengths on a helmet 10. The magnets 16 may be formed in various shapes, e.g., a disc, a block, a ring, a cylinder, a flat sheet, and/or a curved sheet, or some other suitable configuration, and movably coupled to the magnetic holding device 26. Preferably, ring magnets are used, such as shown in FIG. 6. Ring magnets are configured to produce a variable magnetic field based on their design, a change of air gap between the magnetic holding device 26 and the helmet 10, and the movements of the magnets along a lubricated surface of the magnetic holding device 26, as described in more detail below. As shown in FIG. 7, ring magnets provide for less concentration of perpendicular flux within the empty center of the various magnets, providing a staccato or "anti-lock braking" deceleration, resulting in the gradual braking between two helmets approaching one another.

As shown in FIG. 6, an array of magnets 16 may be applied to the magnetic holding device 26 to produce a variable magnetic field gradient (e.g., a lower field as distance is increased from the outer shell of the helmet and a higher field closer to the helmet outer shell) as well as a heterogeneous or non-uniform magnetic flux field. For example, smaller magnets may be positioned between the larger magnets, such as shown in FIG. 6, in order to provide a magnetic flux field just outside the helmet that minimizes the opposing magnets seeking the opposite pole of the larger magnets between the gap of the magnets and a different final repulsive magnetic flux field when the helmets approach one another closer to potential impact.

The magnetic holding device 26 may be dry molded to the inner surface 12*b* of the helmet without any glues or adhesives between the helmet 10 and the magnetic holding device 26. The presence of space between the magnetic holding device 26 and the inner surface 12*b* of the outer shell 12 creates an air gap, which is minimized when two magnetic helmets approach one another, allowing for a more controlled deceleration of the helmets 10 over time. While the repulsive magnetic forces of two helmets approaching each other would increase the gap within both helmets, the head of each player, surrounded by padding, holds the magnetic system in place causing the gap to close upon impact. As the gap closes, more magnetic repulsive braking is experienced by the player.

One or more strips of the magnetic holding device 26 may be secured to one another, e.g., glued together side by side with an adhesive, prior to the installation of any magnets 16. In such a configuration, the magnetic holding device 26 may completely cover the inner surface 12*b* of the outer shell. The glue, epoxy or other adhesive is not applied to the helmet. A lubricant, such as silicone spray or oil, may be applied to one surface of the magnetic holding device 26 closest to the head and away from the inner surface 12*b* of the helmet. The one or more magnets 16 may then be applied to the surface of the magnetic holding device 26 with the lubricant. The magnets 16 are not glued or secured in place, but rather are affixed to the magnetic holding device 26 through magnetic attraction to the ferrous material within the magnetic holding device 26 and the magnet 16 (e.g., the south pole of the magnetic holding device 26 attracts the north pole of the magnet). In this way, the magnets 16 are able to slide freely upon the surface of the magnetic holding device 26, while remaining firmly in contact with the magnetic holding device 26. The magnets 16 may also be applied over the seams between the strips of the magnetic holding device 26.

When two magnetic helmets 10 approach one another, field gradients from the opposing helmet exert forces on the magnets 16 on the magnetic holding device 26, causing the movement of magnets 16 along the lubricated surface of the magnetic holding device 26 within both helmets, further decreasing helmet to helmet velocity in a more controlled deceleration. As the opposing helmet approaches, magnetic flux from the opposing helmet interacts with the magnetic flux of the player's helmet, causing the magnets of both helmets to slide laterally along the surface of the magnetic holding device 26. This phenomenon is accentuated as a result of the curvature of an athletic helmet. The lateral movement due to the repulsive forces is limited to the moving magnets 16, and its surrounding magnets, on the magnetic holding device 26. This lateral movement creates lateral forces for the magnets 16 residing on the magnetic holding device 26. The lateral forces cause a rebound effect such that the affected magnets moving laterally spring back or rebound to their original position following impact. The lateral movement of magnets 16 further allows a controlled deceleration between helmets 10. If the magnets 16 are fixed, the approaching helmet may force the helmets to rotate about an axis (torque), potentially leading to additional head and neck trauma.

Alternatively, the magnetic holding device 26 may be coupled to the inner surface 12*b* of the helmet 10 in any suitable manner e.g., using mechanical and/or chemical means. For example, the magnetic holding device 26 may be affixed to the inner surface 12*b* of the helmet 10 with glues and adhesives, such as epoxy, cyanoacrylate, and urethane adhesives, or mechanically attached to the inner surface 12*b* with hardware, such as bolts, nuts or screws.

Similar to the embodiment shown in FIGS. 2 and 3, the magnets 16 may be disposed over substantially all of the contact area of the inner surface 12*b*. The orientation of the surface magnets 16, while offering many designs, should, preferably, offer maximum surface magnetic repulsion of other helmets. The one or more magnets 16 may be formed from any material composition, e.g., ceramic or ferrite magnets, Alnico magnets, samarium-cobalt magnets and/or neodymium magnets. The one or more magnets 16 may be coated with any suitable material, e.g., rubber or other coatings, in order to protect the magnets and reduce the chance of the magnet breaking upon contact with other magnets 16 or helmets 10.

The athletic helmet 10 shown in FIGS. 2 through 4 may further include a flux shunt 22 disposed adjacent to the inner surface 12*b* of the outer shell 12. The flux shunt 22 is configured to shield the head from flux from the magnetic system 14, further reducing or eliminating any magnetic effect upon the brain. An MRI imaging system uses between 1.5 and 3 Tesla, although 7 Tesla scanners are not unusual. These head scans take approximately 30 minutes to complete. An average football game lasts over 3 hour and there are 16 regular season professional football games per year, excluding playoff games and practices. Therefore, during the course of a year, a professional football player wears his helmet for approximately 50 hours or more, the equivalent of 100 head MRI scans per year. The cerebral effects of prolonged exposure to a magnetic field is unknown, and therefore, prudence mandates elimination of a magnetic flux penetrating into the head and brain. The flux shunt 22 may be made of any suitable material, e.g., a sheet of magnetic flux shielding material such as permalloy, mu-metal shielding, or ferromagnetic nanocrystalline metal magnetic shield coatings. The flux shunt 22 may be coupled to the inner surface 12*b* of the helmet 10 when the magnetic system is coupled to the outer surface of the helmet, or coupled to the magnetic system 14 or padding 28 when the magnetic system is adjacent to the inner surface of the helmet, such as shown in FIG. 4. The flux shunt 22 may be positioned within the padding so as to be closer to the head. One or more layers of magnetic flux shielding material may be used for the flux shunt 22 in order to produce an absence of magnetic field on the side of the magnets facing the head, reducing or eliminating any magnetic effect upon the brain.

Figure 8:
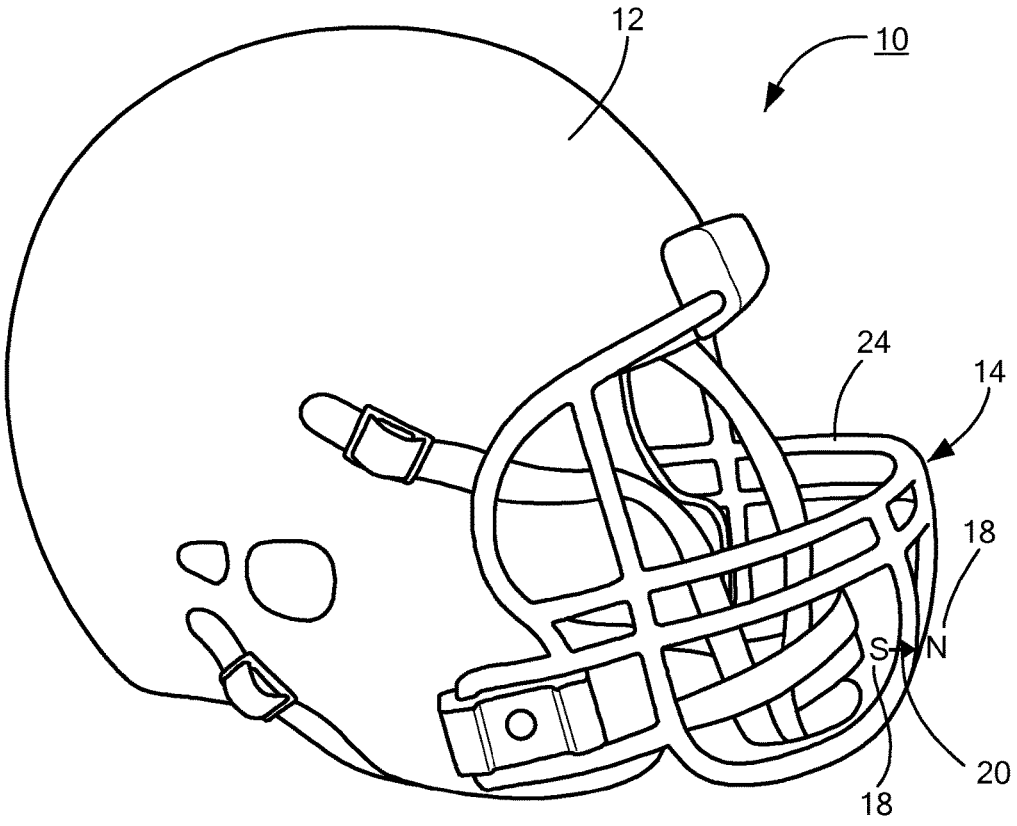
FIG. 8 schematically shows an athletic helmet having a face guard with a magnetic system according to embodiments of the present invention.

As shown in FIG. 8, the athletic helmet 10 may include a face mask or guard 24 disposed on a portion of the outer shell 12. The face guard 24 may include a magnetic system 14 disposed on or in the face guard, as described above with regard to the outer shell of the helmet 10. The magnetic system 14 in the face guard 24 includes at least one magnet 16 configured to have one pole aligned such that its magnetic dipole moment is oriented approximately normal to the outer surface of the face guard 24. The magnets 16 may be formed in various shapes and attached to the outer surface of the face guard 24 or be embedded in the face guard 24 as described above with regard to FIG. 2. In addition, the face guard 24 may be made of a ferromagnetic material. For example, the face guard 24 may include steel wiring that is magnetized such that the north pole faces outward and the south pole faces toward the players face, as shown in FIG. 8. In this way, the face guard 24 would repel any oncoming face guards of an opponent with a similarly oriented magnetic system 14 (e.g., the north pole facing outward and the south pole facing toward the players face).

Although the above discussion discloses various exemplary embodiments of the invention, it should be apparent that those skilled in the art may make various modifications that will achieve some of the advantages of the invention without departing from the true scope of the invention.

What is claimed is:

1. An athletic helmet comprising:

an outer shell shaped to receive a head, the outer shell having an inner surface; and a magnetic system disposed adjacent to the inner surface, the magnetic system having at least two magnets, each magnet configured to have one pole aligned such that its magnetic dipole moment is oriented approximately normal to the inner surface and a magnetic holding device having a surface that is shaped to follow a curvature of the inner surface and configured to allow the at least two magnets to slidably move laterally along the surface of the magnetic holding device in a direction normal to the magnetic dipole moment, wherein the at least two magnets are removably coupled to the magnetic holding device through magnetic attraction.

2. An athletic helmet according to claim 1, wherein the magnetic holding device is coupled to the inner surface of the outer shell.

3. An athletic helmet according to claim 1, wherein the magnetic holding device is formed from a rubber material.

4. An athletic helmet according to claim 3, wherein the rubber material is partially formed with magnetic ferrous material and is configured so that a north pole is located on one side of the magnetic holding device and a south pole is located on an opposite side of the magnetic holding device.

5. An athletic helmet according to claim 3, wherein the magnetic holding device is partially formed with a magnetic material, and the magnetic material includes magnetized ferrous material.

6. An athletic helmet according to claim 1, wherein the magnetic system includes a plurality of magnets disposed in an array, wherein each magnet is in contact with the surface of the magnetic holding device.

7. An athletic helmet according to claim 6, wherein the array of magnets includes smaller magnets disposed between larger magnets in order to form a non-uniform magnetic flux field, wherein the magnetic holding device is configured to allow each of the magnets to slidably move laterally along the surface of the magnetic holding device.

8. An athletic helmet according to claim 1, further comprising a flux shunt disposed adjacent to the magnetic system and positioned between the magnetic system and the head in order to shield the head from flux from the magnetic system.

9. An athletic helmet according to claim 1, wherein the magnetic system is disposed over substantially all of a contact area of the inner surface.

10. An athletic helmet according to claim 1, wherein the outer shell includes an outer surface, the helmet further comprising:

a face guard disposed on a portion of the outer shell, the face guard having a face guard magnetic system disposed on or in the face guard, the face guard magnetic system having at least one magnet configured to have one pole aligned such that its magnetic dipole moment is oriented approximately normal to an outer surface of the face guard.

11. An athletic helmet according to claim 1, wherein one or more of the magnets has a shape of a disc, a block, a ring, a cylinder, a flat sheet, a curved sheet, or combinations thereof.

12. A plurality of athletic helmets, wherein each athletic helmet is according to claim 1 and each has its magnetic system configured with the same pole oriented toward an outer surface, such that a repulsive force is produced between two or more of the helmets when the helmets come close to or contact one another.

13. An athletic helmet according to claim 1, further comprising padding disposed adjacent to the inner surface, wherein the magnetic system is embedded within the padding.

14. An athletic helmet according to claim 13, wherein the magnetic system includes magnetic particles formed within the padding.

15. An athletic helmet according to claim 13, wherein the magnetic system includes magnets of various shapes and configurations imbedded within the padding.

16. An athletic helmet according to claim 1, further comprising padding, wherein the magnetic system is disposed between the padding and the inner surface.

17. An athletic helmet according to claim 16, wherein the magnetic holding device is coupled to the padding.

18. An athletic helmet according to claim 1, further comprising a lubricant disposed on the surface of the magnetic holding device.

19. An athletic helmet according to claim 18, wherein the lubricant includes a silicone material or oil.

20. An athletic helmet according to claim 8, further comprising padding disposed adjacent to the inner surface, wherein the magnetic system is embedded within the padding.

21. An athletic helmet according to claim 20, wherein the magnetic system includes magnet particles formed within the padding.

22. An athletic helmet according to claim 8, further comprising padding disposed adjacent to the inner surface, wherein the magnetic system is coupled to the padding.

* * * * *